US008889325B2

(12) United States Patent
Konishi et al.

(10) Patent No.: US 8,889,325 B2
(45) Date of Patent: Nov. 18, 2014

(54) ORGANIC PHOTORECEPTOR

(71) Applicant: Konica Minolta, Inc., Tokyo (JP)

(72) Inventors: Mari Konishi, Hino (JP); Keiichi Inagaki, Hino (JP); Toshiyuki Fujita, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/875,504

(22) Filed: May 2, 2013

(65) Prior Publication Data

US 2013/0316277 A1 Nov. 28, 2013

(30) Foreign Application Priority Data

May 24, 2012 (JP) ..... 2012-118713

(51) Int. Cl.

| | |
|---|---|
| ***G03G 5/14*** | (2006.01) |
| ***G03G 5/147*** | (2006.01) |
| ***G03G 5/05*** | (2006.01) |
| ***G03G 5/06*** | (2006.01) |
| ***G03G 5/09*** | (2006.01) |

(52) U.S. Cl.

CPC ..... *G03G 5/14734* (2013.01); *G03G 5/0542* (2013.01); *G03G 5/0546* (2013.01); *G03G 5/0592* (2013.01); *G03G 5/0614* (2013.01); *G03G 5/09* (2013.01); *G03G 5/14704* (2013.01); *G03G 5/14708* (2013.01); *G03G 5/1473* (2013.01); *G03G 5/14791* (2013.01)

USPC ..... 430/66; 430/58.75

(58) Field of Classification Search

USPC ..... 430/58.75, 66

See application file for complete search history.

(56) References Cited

U.S. PATENT DOCUMENTS

2003/0218665 A1* 11/2003 Yasutomi et al. ..... 347/129
2010/0129115 A1* 5/2010 Ishida et al. ..... 399/159

FOREIGN PATENT DOCUMENTS

JP 60-172044 9/1985
JP 2010-169725 A 8/2010

* cited by examiner

*Primary Examiner* — Peter Vajda
(74) *Attorney, Agent, or Firm* — Lucas & Mercanti, LLP

(57) ABSTRACT

The invention provides a means for improving the abrasion resistance and the scratch resistance of a protection layer by increasing the surface hardness of the protection layer of an organic photoreceptor. The invention is an organic photoreceptor constituted by laminating on an electroconductive substrate, a photosensitive layer and a protection layer successively, wherein the protection layer comprises a charge transport substance represented by the following general formula (1), a resin component obtained by curing a curable compound and tin oxide treated with a surface preparation agent having a reactive organic group, and a silica particle:

[Chem. 1]

(1)

in the general formula (1), $R^1$ and $R^2$ are each independently hydrogen atoms or methyl groups, and $R^3$ is a straight-chain or branched alkyl group having 1 to 5 carbon atoms.

10 Claims, 1 Drawing Sheet

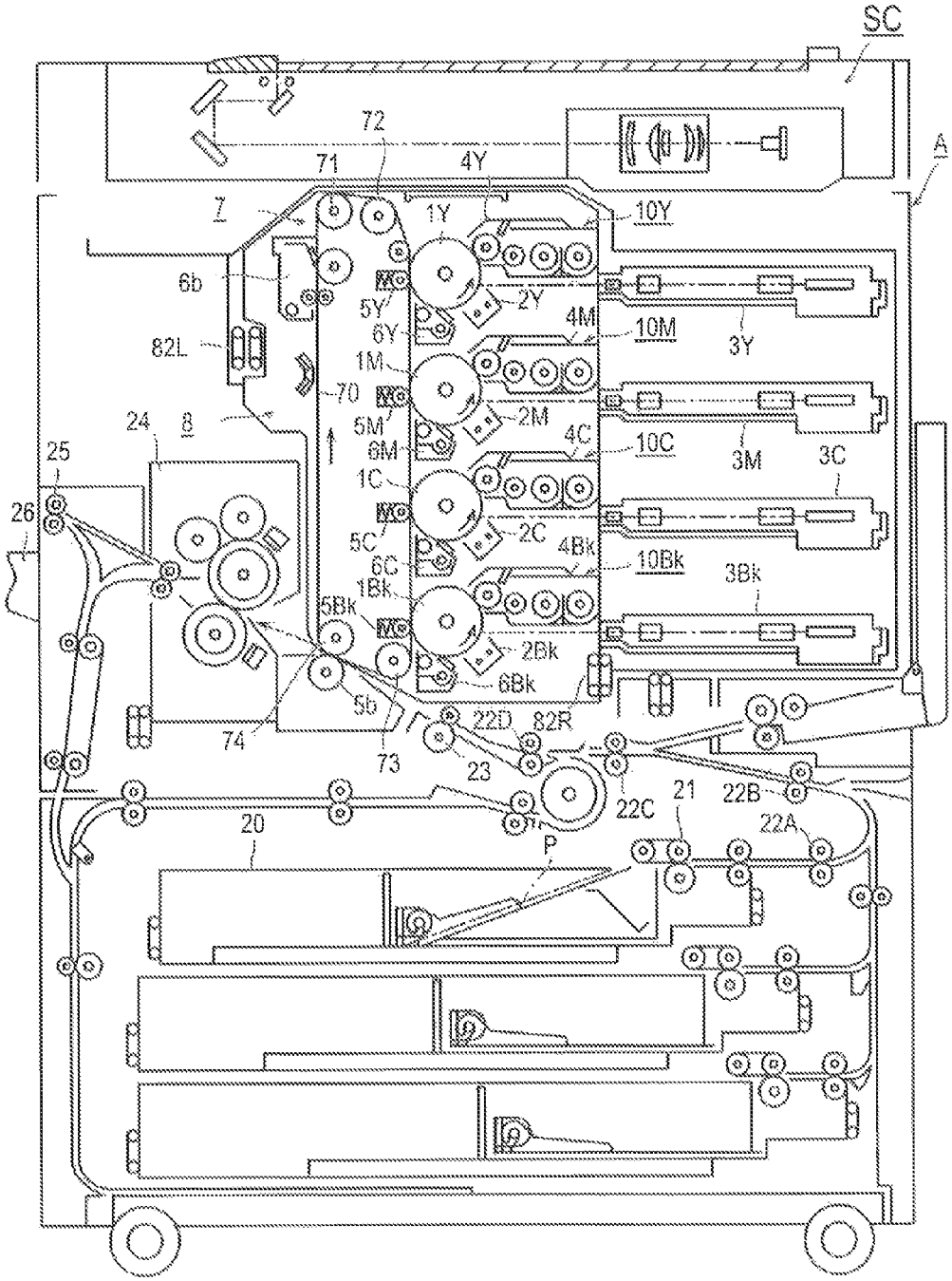
SC
A
72
71
4Y
Z
1Y
10Y
6b
5Y
2Y
6Y
4M
10M
3Y
82L
1M
70
5M
2M
6M
4C
10C
3M
3C
24
8
25
26
1C
5C
2C
6C
4Bk
10Bk
3Bk
1Bk
5Bk
2Bk
6Bk
5b
22D
82R
74
73
23
22C
21
22B
22A
20
P

ORGANIC PHOTORECEPTOR

CROSS-REFERENCE TO RELATED APPLICATION

This application is based on Japanese Patent Application No. 2012-118713 filed on May 24, 2012, the entire contents of which are incorporated herein by reference.

BACKGROUND

1. Technical Field

The present invention relates to an organic photoreceptor.

2. Description of Related Arts

Since an organic photoreceptor has such advantages as broader selection range of source materials, better environmental compatibility, lower production cost, etc. compared to an inorganic photoreceptor, such as a selenium photoreceptor, and an amorphous silicon photoreceptor, it has been recently becoming a mainstream of an electrophotographic photoreceptor replacing the position of an inorganic photoreceptor.

By an image formation method based on the Carlson method, an organic photoreceptor is charged, an electrostatic latent image is formed, a toner image is formed, and then the toner image is transferred to a transfer paper, which is fixed to form a final image.

While, in a recent image formation method, digitalization has advanced, and for formation of an electrostatic latent image on an organic photoreceptor, an image formation method using laser light as an exposing source is widely employed. Further, a high-definition image formation method using shortwave laser light having the oscillation wavelength of 500 nm or less as an exposing source has been recently proposed.

Meanwhile, the use of an image formation method according to exposure by shortwave laser light overlaps the uses as a printer requiring high image quality and large quantity printing and a high speed color printer, and therefore an organic photoreceptor to be used in the image formation method is required to have properties for an electrophotographic photoreceptor with high image quality and high durability suitable for latent image formation by shortwave laser light and high speed printing.

In this connection, an organic photoreceptor has a drawback in that the surface thereof tends to wear due to friction with a contacting component such as a cleaning component. To prevent such wear deterioration of the surface layer, a photoreceptor using a polycarbonate resin with high abrasion resistance, such as a polycarbonate resin having a cyclohexylene group (also called as polycarbonate Z), as a binder for a charge transport layer, has been proposed (JP-A-60-172044).

However, the improvement of the abrasion resistance of an organic photoreceptor by using the binder was not satisfactory, and especially if a charge transport compound is added in the surface layer (protection layer), the improvement effect was limited.

Further, in order to improve the abrasion resistance of a photoreceptor, a photoreceptor provided with a protection layer of a cross-linked cured resin composed of a composition of an acrylic polymerizable compound, a charge transport compound having a polymerizable functional group, and a metallic oxide particle treated with a surface preparation agent having a polymerizable functional group on the surface layer of a photoreceptor, has been proposed (JP-A-2010-169725).

SUMMARY

However, by the technology according to JP-A-2010-169725, improvement of the surface hardness of a protection layer was not sufficient and there has remained a problem that the abrasion resistance or the scratch resistance of a protection layer is not improved satisfactorily.

Under such circumstances, an object of the present invention is to provide a means for improving the abrasion resistance and the scratch resistance of a protection layer by increasing the surface hardness of the protection layer of an organic photoreceptor.

The present inventors studied diligently in order to attain the object. As the result it was found that the surface hardness of a protection layer could be increased by adding a silica particle in a protection layer, and thereby enhancing the abrasion resistance or the scratch resistance of the protection layer. Further, it was found that increase in the residual potential or appearance of the image memory on the protection layer surface could be suppressed by adopting the constitution, thereby completing the present invention.

Namely, the present invention is an organic photoreceptor constituted laminating on an electroconductive substrate, a photosensitive layer and a protection layer successively, wherein the protection layer comprises a charge transport substance represented by the following general formula (1), a resin component obtained by curing a curable compound and tin oxide treated with a surface preparation agent having a reactive organic group, and a silica particle:

[Chem. 1]

(1)

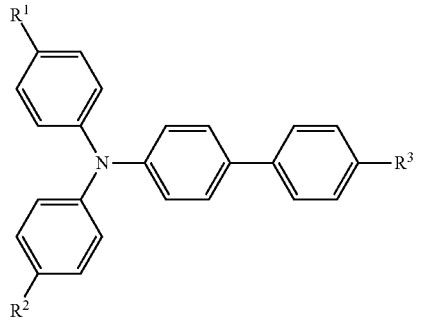

in the general formula (1), $R^1$ and $R^2$ are each independently hydrogen atoms or methyl groups, and $R^3$ is a straight-chain or branched alkyl group having 1 to 5 carbon atoms.

BRIEF DESCRIPTION OF THE DRAWINGS

FIG. 1 is a schematic sectional view showing a color image formation apparatus of an embodiment according to the present invention.

DETAILED DESCRIPTION

The present invention is an organic photoreceptor constituted by laminating on an electroconductive substrate, a photosensitive layer and a protection layer successively, wherein the protection layer comprises a charge transport substance represented by the above general formula (1) a resin component obtained by curing a curable compound and tin oxide treated with a surface preparation agent having a reactive organic group, and a silica particle. By adopting such a constitution the surface hardness of the protection layer can be enhanced and the abrasion resistance or the scratch resistance of the protection layer can be improved.

Further, according to the present invention, increase in the residual potential or appearance of the image memory on the protection layer surface can be suppressed. This is because, although detailed causes of such an effect have not yet been known, if a silica particle is absent, the surface of a protection layer is nearly even, but unevenness in residue of a lubricant agent, etc. on the protection layer surface appears after a contact with a contacting component such as a cleaning component, which causes locally such phenomena as increase in the residual potential or appearance of the image memory.

On the other hand, if the protection layer contains a silica particle, the silica particle imparts appropriate roughness to the protection layer surface, and a lubricant agent, etc. remains all the better homogeneously on the protection layer surface after a contact of the protection layer with a contacting component such as a cleaning component. If the lubricant agent, etc. remains homogeneously on the protection layer surface, a discharge product can be easily cleaned off. Presumably, according to such mechanism, the increase in the residual potential or the appearance of the image memory on the protection layer surface can be suppressed, provided that the mechanism is presumptive and the present invention is by no means restricted by the above mechanism.

The constitution of an organic photoreceptor according to the present invention will be described below.

[Protection Layer]

<Charge Transport Substance>

A protection layer according to the present invention contains as a charge transport substance a compound represented by the following general formula (1):

[Chem. 2]

(1)

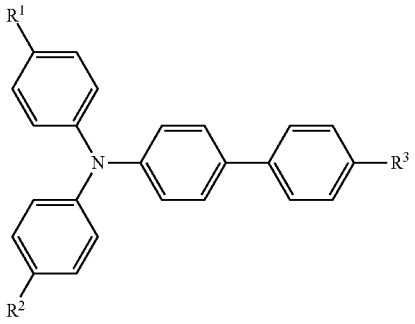

In the general formula (1), $R^1$ and $R^2$ are each independently hydrogen atoms or methyl groups, and $R^3$ is a straight-chain or branched alkyl group having 1 to 5 carbon atoms.

The compounds represented by the general formula (1) are charge transport substances transporting a charge carrier in the protection layer. They show no absorption in a shortwave region and most of them have the molecular weight not higher than 450 (preferably not less than 320 and not more than 420) so that they can penetrate into voids in the resin component of the protection layer. Consequently, they can inject smoothly charge carriers from a charge transport layer without lowering the abrasion resistance of the protection layer, and transport charges to the protection layer surface with almost no increase in the residual potential nor appearance of the image memory.

Although in the general formula (1), $R^1$ and $R^2$ are each independently hydrogen atoms or methyl groups, from a viewpoint of production stability, $R^1$ and $R^2$ are preferably different from each other.

Examples of a straight-chain or branched alkyl group having 1 to 5 carbon atoms to be used as $R^3$ in the general formula (1) include a methyl group, an ethyl group, a propyl group, an isopropyl group an n-butyl group, an isobutyl group, tert-butyl group, an n-pentyl group, an isopentyl group, a neopentyl group, a tert-pentyl group, and a 2-methylbutyl group. Among them, from a viewpoint of solubility, a propyl group, an n-butyl group, and an n-pentyl group are preferable.

Specific examples of a compound represented by the general formula (1) are shown below:

[Chem. 3]

CTM-1

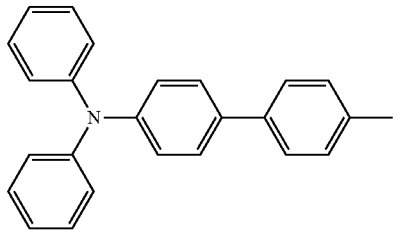

(Mol. weight 321.43)

CTM-2

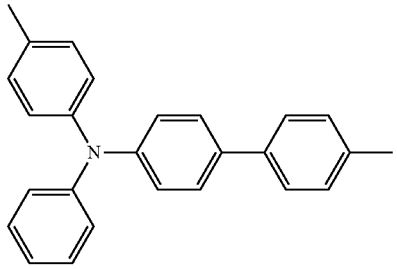

(Mol. weight 349.48)

CTM-3

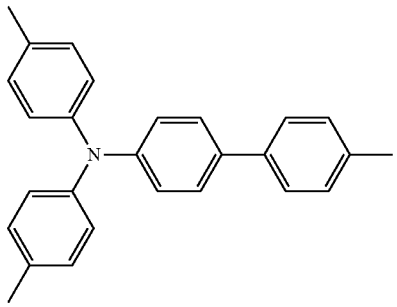

(Mol. weight 363.51)

CTM-4

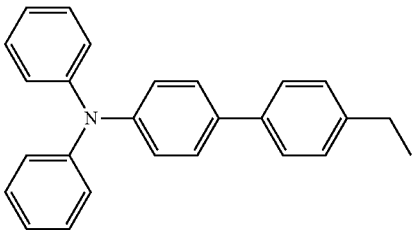

(Mol. weight 349.48)

-continued
CTM-5
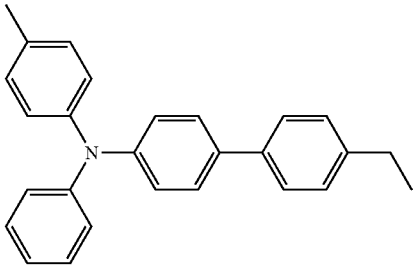
(Mol. weight 363.51)
CTM-6
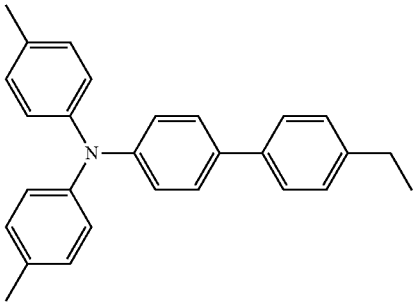
(Mol. weight 377.53)
CTM-7
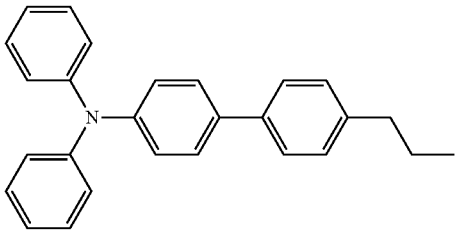
(Mol. weight 363.51)
CTM-8
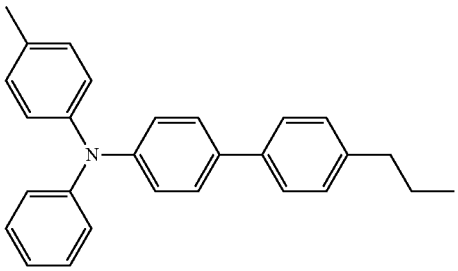
(Mol. weight 377.53)
[Chem. Expression 4]
CTM-9
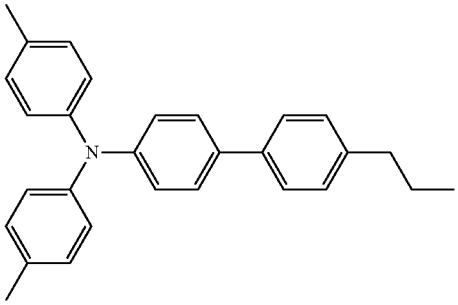
(Mol. weight 391.56)
-continued
CTM-10
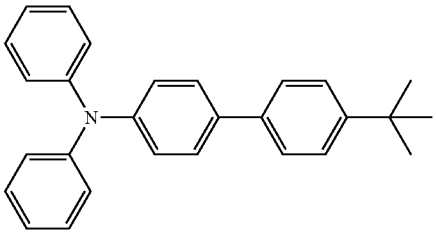
(Mol. weight 377.53)
CTM-11
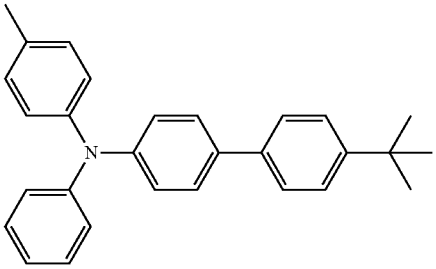
(Mol. weight 391.66)
CTM-12
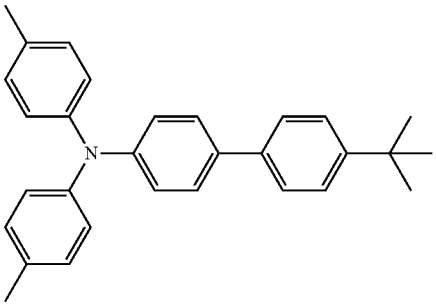
(Mol. weight 405.59)
CTM-13
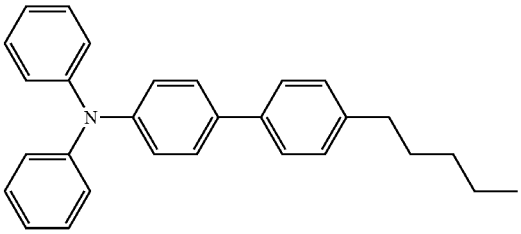
(Mol. weight 391.56)
CTM-14
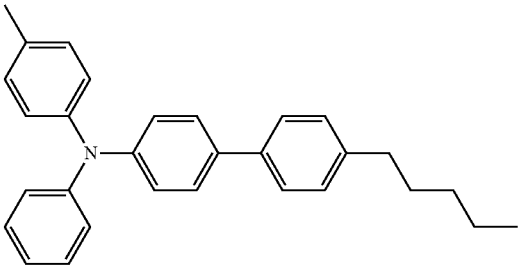
(Mol. weight 405.59)

-continued

CTM-15

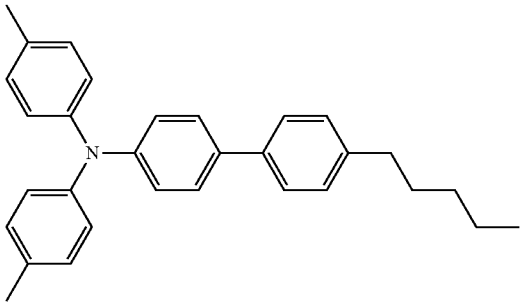

(Mol. weight 419.62)

For the charge transport substance a commercial product may be used, or a synthesized product may be used. An example of the synthesis process is described in JP-A2006-143720. The charge transport substances may be used singly or in combination of 2 or more thereof.

The addition amount of a charge transport substance represented by the general formula (1) in a protection layer with respect to 100 parts by weight of the curable compound described below is preferably 2 to 60 parts by weight, more preferably 5 to 50 parts by weight, and further preferably 10 to 35 parts by weight.

<Resin Component>

A protection layer according to the present invention contains a resin component composed of a curable compound and tin oxide surface-treated with a surface preparation agent having a reactive organic group.

<<Curable Compound>>

A curable compound to be used according to the present invention will be described below.

As the curable compound a monomer or an oligomer, which is polymerized (cured) when irradiated with an active energy ray, such as an ultraviolet ray and an electron beam, to be a binder resin (resin component) in a protection layer, is favorably used. Specific examples thereof include a styrene monomer, a styrene oligomer, a (meth)acrylic monomer, a (meth)acrylic oligomer, a vinyltoluene monomer, a vinyltoluene oligomer, a vinyl acetate monomer, a vinyl acetate oligomer, an N-vinylpyrrolidone monomer, and an N-vinylpyrrolidone oligomer.

Among others, since curing with small quantity of light or within a short time is possible, a (meth)acrylic monomer or a (meth)acrylic oligomer, which has an acryloyl group ($CH_2{=}CHCO{-}$) or a methacryloyl group ($CH_2{=}CCH_3CO{-}$) and is radically polymerizable, is more preferable.

The curable compounds may be used singly or in combination of 2 or more kinds-thereof.

Specific examples of a curable compound are shown below:

[Chem. 5]

M1

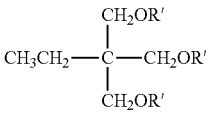

-continued

M2

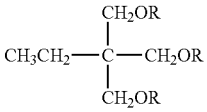

M3

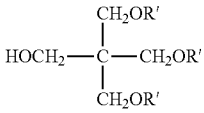

M4

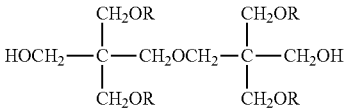

M5

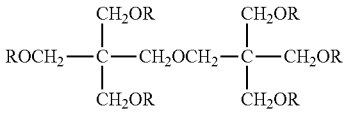

M6

M7

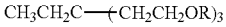

[Chem. 6]

M8

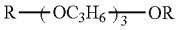

M9

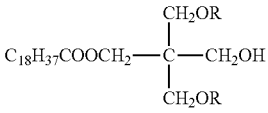

M10

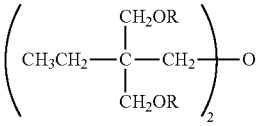

M11

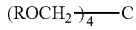

M12

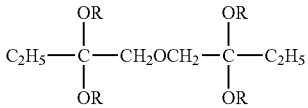

M13

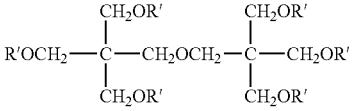

M14

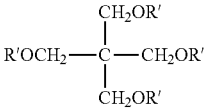

Wherein R represents the following acryloyl group, and R' represents the following methacryloyl group.

[Chem. 7]

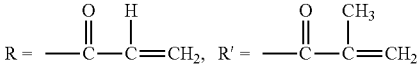

The curable compound is preferably a compound having 3 or more curable functional groups. Further, as the curable compound, a combination of 2 or more kinds of compounds may be used, and also in this case as the curable compound, a compound having 3 or more curable functional groups is preferably used in an amount of 50 weight % or more with respect to the total amount of the curable compound. Further, the equivalent of a curable functional group in a curable compound, namely "molecular weight of a curable compound/number of curable functional groups in a curable compound" is preferably 1000 or less, and more preferably 500 or less. By this means, the crosslink density becomes high and the abrasion resistance of a protection layer can be improved.

For inducing a reaction of a curable compound to be used according to the present invention, a method for inducing a reaction by electron beam cleavage, or a method for inducing a curing reaction by light or heat with adding a radical polymerization initiator or a cationic polymerization initiator is applied. As a radical polymerization initiator and a cationic polymerization initiator, each of a photopolymerization initiator and a thermal polymerization initiator can be used, and both of a photopolymerization initiator and a thermal polymerization initiator may be used together.

As a radical polymerization initiator, a photopolymerization initiator is preferable, and among them, an acetophenone compound, or a phosphine oxide compound is preferable. Especially a compound having an α-hydroxyacetophenone structure, or an acylphosphine oxide structure is preferable. While, examples of a cationic polymerization initiator include ionic polymerization initiators, such as a $B(C_6F_5)_4^-$ salt, a $PF_6^-$ salt, an $AsF_6^-$ salt, an $SbF_6^-$ salt, and a $CF_3SO_3^-$ salt of aromatic onium ions including an aromatic diazonium ion, an aromatic ammonium ion, an aromatic iodonium ion, an aromatic sulfonium ion, and an aromatic phosphonium ion; and non-ionic polymerization initiators, such as a sulfonate generating a sulfonic acid, a halogenide generating a hydrogen halide and an iron-arene complex. Especially, non-ionic polymerization initiators of a sulfonate generating a sulfonic acid, and a halogenide generating a hydrogen halide are preferable.

Photopolymerization initiators used preferably are shown below. In the following chemical formulas, polymerization initiators 1-1 to 1-6 are α-aminoacetophenone compounds, polymerization initiators 2-1 to 2-6 are α-hydroxyacetophenone compounds, polymerization initiators 3-1 to 3-2 are acylphosphine oxide compounds, and polymerization initiators 4-1 to 4-3 and 5-1 are polymerization initiators having other structures.

[Chem. 8]

1-1

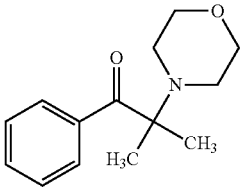

Polymerization Initiator

-continued 1-2

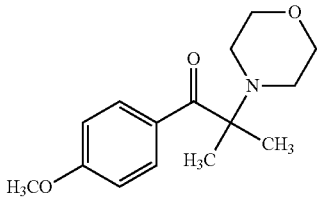

Polymerization Initiator 1-3

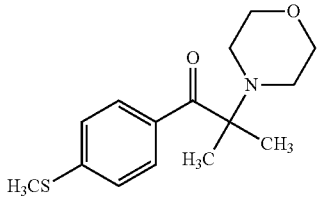

Polymerization Initiator 1-4

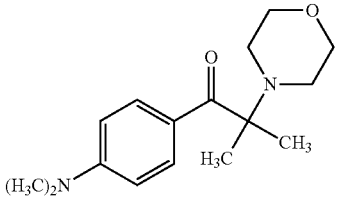

Polymerization Initiator 1-5

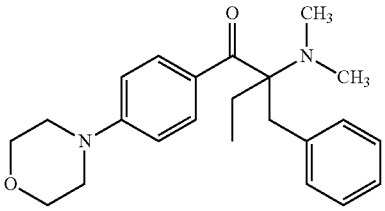

Polymerization Initiator 1-6

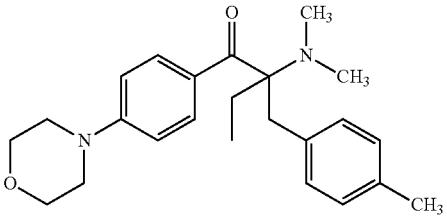

Polymerization Initiator

[Chrm. 9]

2-1

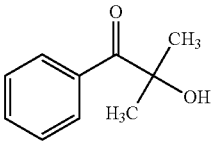

Polymerization Initiator

-continued 2-2

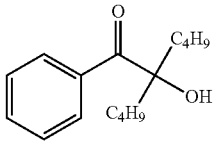

Polymerization Initiator 2-3

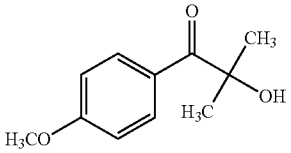

Polymerization Initiator 2-4

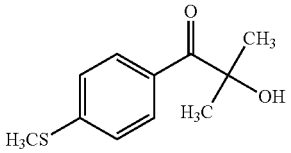

Polymerization Initiator 2-5

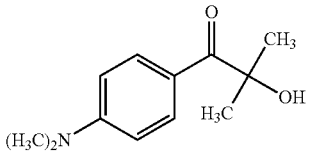

Polymerization Initiator 2-6

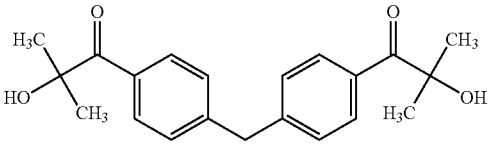

Polymerization Initiator 3-1

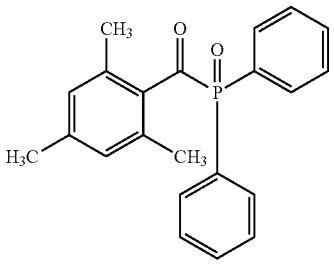

Polymerization Initiator 3-2

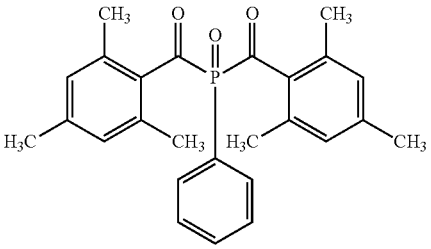

Polymerization Initiator

-continued

[Chem. 10]

4-1

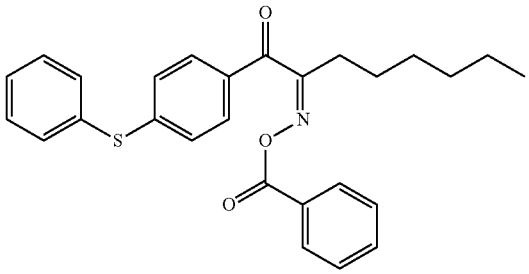

Polymerization Initiator 4-2

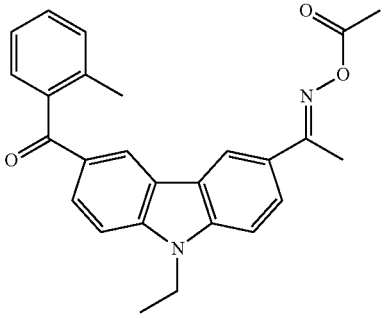

Polymerization Initiator 4-3

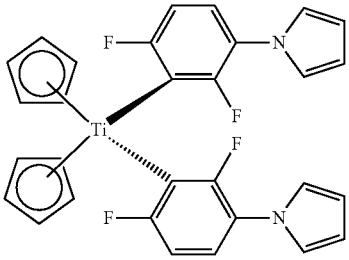

Polymerization Initiator 5-1

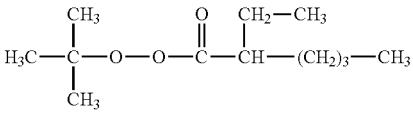

Polymerization Initiator

While, as a thermal polymerization initiator, a ketone peroxide compound, a peroxyketal compound, a hydroperoxide compound, a dialkyl peroxide compound, a diacyl peroxide compound, a peroxydicarbonate compound, a peroxy ester compound, etc. are used, and the above thermal polymerization initiators are disclosed in commercial product catalogs, etc.

The polymerization initiators may be used singly or in combination of 2 or more kinds thereof. The addition amount of a polymerization initiator is preferably 0.1 to 20 parts by weight, and more preferably 0.5 to 10 parts by weight, with respect to 100 parts by weight of the curable compound.

<Tin Oxide Surface-Treated with Surface Preparation Agent>

Tin oxide surface-treated with a surface preparation agent having a reactive organic group (hereinafter also referred to simply as "surface-treated in oxide") is cured (polymerized) together with the curable compound to form a resin component in a protection layer.

The number average primary particle size of tin oxide prior to a surface treatment is preferably in arrange of 1 to 300 mm, more preferably in the range of 3 to 100 nm, and further preferably in the range of 5 to 40 nm, in this regard, the number average primary particle size can be determined by taking 10,000-fold photomicrograph by a scanning electron microscope (by JEOL Ltd.), capturing the photographic image by a scanner, and analyzing 300 particles thereon randomly selected (excluding agglomerated particles) by an automated image processor LUZEX AP (by Nireco Corporation) with a software Ver. 1.32.

Tin oxide is surface-treated with a surface preparation agent having a reactive organic group, and the reactive organic group is preferably an acryloyl group or a methacryloyl group. In other word, tin oxide is preferably surface-treated with a surface preparation agent having an acryloyl group or a methacryloyl group.

Examples of the surface preparation agent having an acryloyl group or a methacryloyl group include compounds represented by the following chemical formulas S-1 to S-34.

[Chem. 11]

$CH_2{=}CHSi(CH_3)(OCH_3)_2$ S-1

$CH_2{=}CHSi(OCH_3)_3$ S-2

$CH_2{=}CHSiCl_3$ S-3

$CH_2{=}CHCOO(CH_2)_2Si(CH_3)(OCH_3)_2$ S-4

$CH_2{=}CHCOO(CH_2)_2Si(OCH_3)_3$ S-5

$CH_2{=}CHCOO(CH_2)_3Si(CH_3)(OCH_3)_2$ S-6

$CH_2{=}CHCOO(CH_2)_3Si(OCH_3)_3$ S-7

$CH_2{=}CHCOO(CH_2)_2Si(CH_3)Cl_2$ S-8

$CH_2{=}CHCOO(CH_2)_2SiCl_2$ S-9

$CH_2{=}CHCOO(CH_2)_3Si(CH_3)Cl_2$ S-10

$CH_2{=}CHCOO(CH_2)_3SiCl_3$ S-11

$CH_2{=}C(CH_3)COO(CH_2)_2Si(CH_3)(OCH_3)$ S-12

$CH_2{=}C(CH_3)COO(CH_2)_2Si(OCH_3)_3$ S-13

$CH_2{=}C(CH_3)COO(CH_2)_3Si(CH_3)(OCH_3)_2$ S-14

$CH_2{=}C(CH_3)COO(CH_2)_3Si(OCH_3)_3$ S-15

$CH_2{=}C(CH_3)COO(CH_2)_2Si(CH_3)Cl_2$ S-16

$CH_2{=}C(CH_3)COO(CH_2)_2SiCl_3$ S-17

$CH_2{=}C(CH_3)COO(CH_2)_3Si(CH_3)Cl_2$ S-18

$CH_2{=}C(CH_3)COO(CH_2)_3SiCl_3$ S-19

$CH_2{=}CHSi(C_2H_5)(OCH_3)_2$ S-20

$CH_2{=}C(CH_3)Si(OCH_3)_3$ S-21

$CH_2{=}C(CH_3)Si(OC_2H_5)_3$ S-22

-continued $CH_2{=}CHSi(OCH_3)_3$ S-23

$CH_2{=}C(CH_3)Si(CH_3)(OCH_3)_2$ S-24

$CH_2{=}CHSi(CH_3)Cl_2$ S-25

$CH_2{=}CHCOOSi(OCH_3)_3$ S-26

$CH_2{=}CHCOOSi(OC_2H_5)_3$ S-27

$CH_2{=}C(CH_3)COOSi(OCH_3)_3$ S-28

$CH_2{=}C(CH_3)COOSi(OC_2H_5)_3$ S-29

$CH_2{=}C(CH_3)COO(CH_2)_3Si(OC_2H_5)_3$ S-30

[Chem. 12]

S-31

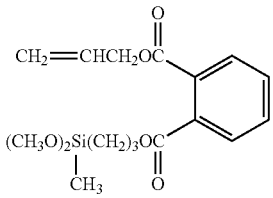

S-32

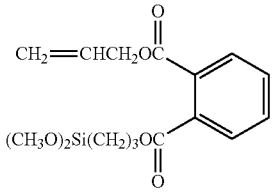

S-33

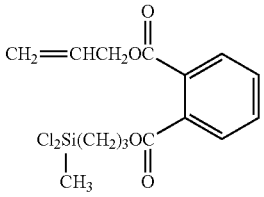

S-34

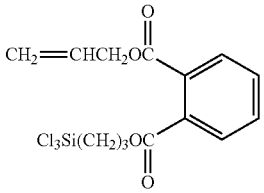

Among the surface preparation agents, compounds represented by the chemical formulas S-4 to S-7, S-12 to S-15, and S-24, which have a methoxy group at the end, are more preferable.

The addition amount of surface-treated tin oxide in a protection layer is, with respect to 100 parts by weight of the curable compound, preferably 20 to 170 parts by weight, and more preferably 25 to 130 parts by weight. The surface-treated tin oxide may be used singly or in combination of 2 or more kinds thereof.

There is no particular restriction on a production process of surface-treated tin oxide according to the present invention, and by an exemplar method, without limited thereto, a slurry containing tin oxide, a surface preparation agent having a reactive organic group and a solvent is prepared and subjected to wet grinding and a surface treatment using a wet-type media agitating disperser, and then the solvent is removed.

When a slurry containing tin oxide and a surface preparation agent having a reactive organic group is prepared and ground in a wet state, the tin oxide can be pulverized and at the same time the surface treatment of the tin oxide proceeds. Thereafter, the solvent is removed and the tin oxide becomes powder to yield homogeneous and finer tin oxide surface-treated with a surface preparation agent.

The amount of a surface preparation agent having a reactive organic group used for the surface treatment is preferably 0.1 to 200 parts by weight, and further preferably 7 to 70 parts by weight with respect to 100 parts by weight of the tin oxide prior to the treatment. The surface preparation agents may be used singly or in combination of 2 or more kinds thereof.

Further, the amount of a solvent used for preparing a slurry is preferably 50 to 5000 parts by weight with respect to 100 parts by weight of the tin oxide prior to the treatment. Examples of a solvent to be used include toluene, xylene, methylene chloride, 1,2-dichloroethane, methyl ethyl ketone, cyclohexane, ethyl acetate, t-butyl acetate, methanol, ethanol, n-propyl alcohol, isopropyl alcohol, n-butyl alcohol term-butyl alcohol, sec-butyl alcohol, methyl cellosolve, 4-methoxy-4-methyl-2-pentanone, ethyl cellosolve, tetrahydrofuran, 1-dioxane, 1,3-dioxolane, pyridine, and diethylamine. The solvents may be used singly or in combination of 2 or more kinds thereof.

A wet-type media agitating disperser which is a surface-treatment apparatus to be used according to the present invention is an apparatus having a case filled with beads as media, and agitation disks mounted vertical to a rotation axis, rotating at a high speed to exert functions of pulverizing and dispersing agglomerated particles of metallic oxide particles. There is no particular restriction on the structure thereof insofar as tin oxide can be dispersed sufficiently and surface-treated in a surface treatment of tin oxide. Examples of the structure to be adopted include wide range of types, such as a vertical type or a horizontal type, and a continuous type or a batch type. Specific examples include a sand mill, an ultravisco mill, a pearl mill, a grain mill, a DYNO mill, an agitator mill, and a dynamic mill. By the above wet-type media agitating dispersers, using pulverizing media, such as balls and beads, pulverization and dispersion are carried out by way of impact crushing, friction, shear, and shear stress.

As beads to be used for the wet-type media agitating disperser, balls made of materials, such as glass, alumina, zircon, zirconia, iron, and flint can be used, and those made of zirconia or zircon are especially preferable. As for the size of the beads, usually those with the diameter of about 1 to 2 mm are used, but for the purpose of the present invention those with the diameter of about 0.1 to 1.0 mm are preferably used.

For disks or inner walls of a case to be used in a wet-type media agitating disperser, various materials, such as stainless-steel, Nylon (Registered trademark), and ceramics, can be used, but for the purpose of the present invention disks or case inner walls made of ceramics, such as zirconia and silicon carbide are especially preferable.

By the wet grinding and the surface treatment as above, surface-treated tin oxide can be obtained.

<Silica Particle>

A protection layer according to the present invention contains a silica particle. By this means, the surface hardness of a protection layer can be increased, so that the abrasion resistance or the scratch resistance of a protection layer can be improved. Further, increase in the residual potential or appearance of the image memory on a protection layer surface can be suppressed.

Furthermore, since the dielectric constant of the silica particle is small, from a viewpoint of static characteristics, charging ability of a protection layer can be advantageously secured. Further, since the silica particle has small specific gravity, it does not precipitate in a coating liquid, and thereby improving the production stability of a protection layer.

The average primary particle size of a silica particle to be used according to the present invention is preferably 3 to 150 nm, and more preferably 10 to 50 nm. In this regard, the average primary particle, size can be determined by measuring the volume-based particle size of particle by a laser diffraction method.

There is no particular restriction on the kind of a silica particle, and examples thereof include silica by dry-type method, silica by wet-type precipitated method, and silica by wet-type gel-method. Either of hydrophilic silica, having a large number of silanol groups, and hydrophobic silica treated for hydrophobization by trimethylsilylation of silanol groups, a silicone oil, or the like, can be used. The silica particles may be used singly or in combination of 2 or more thereof.

For the silica particle a commercial product may be used, or a synthesized product may be used. Examples of a commercial product of the silica particle include Aerosil (Registered trademark) R-972, R-974, R-976S, R-9200, RX-50, NAX-50, NX-90G, RX-200, R-8200, RX-300, R-812S, R-812, RY-50, NY-50, RY-200S, RY-200, RY-200L, RY-300, NKT-90, and T-805 (the above are made by Nippon Aerosil Co., Ltd.); TG-6110G, TG-810G, TG-811F, TG-308F, and TG-7580F (the above are made by Cabot Corporation) H2000/4, H2000T, H05TM, 1113TM, H20TM, H30TM, H05TD, H13TD, H20TD, and H30TD (the above are made by Clariant); and X-24-9163A (the above is made by Shin-Etsu Chemical Co., Ltd.).

The addition amount of a silica particle with respect to 100 parts by weight of the curable compound is preferably 10 to 50 parts by weight, and more preferably 10 to 25 parts by weight. Within the range, the effect of the present invention can be attained efficiently.

A protection layer according to the present invention may further contain various antioxidants and lubricant agent particles. As an example of a lubricant agent particle is resin particle containing a fluorine atom, and specific examples thereof include a tetrafluoroethylene resin particle, a trifluorochloroethylene resin particle, a hexafluoropropylene-chloroethylene copolymer resin particle, a polyvinyl fluoride resin particle, a polyvinylidene fluoride resin particle, a difluorodichloroethylene resin particle, and 1, or 2 or more kinds of the above copolymer particles. Among others, a tetrafluoroethylene resin particle or a polyvinylidene fluoride resin particle is preferable.

<Method for Forming Protection Layer>

A protection layer according to the present invention can be formed by preparing a coating liquid (a coating liquid for a protection layer) by mixing a charge transport substance represented by the general formula (1) a curable compound, surface-treated tin oxide, a silica particle, and if necessary, a polymerization initiator, etc. in a solvent; coating the coating liquid on the charge transport layer described below; and drying and curing the same.

In the course of the coating, drying and curing, reactions among curable compounds, reactions between curable compounds and reactive organic groups of surface-treated tin oxide, and reactions among surface-treated tin oxide progress to form a protection layer.

As a solvent to be used for a coating liquid for a protection layer, any solvent can be used insofar as it can dissolve or disperse a charge transport substance represented by the general formula (1), a curable compound, surface-treated tin oxide, and a silica particle. Specific examples thereof include, but not limited to, methanol, ethanol, n-propyl alcohol, isopropyl alcohol, n-butyl alcohol, tert-butyl alcohol, sec-butyl alcohol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane pyridine, and diethylamine. The solvents may be used singly or in combination of 2 or more thereof.

There is no particular restriction on a preparation method of a coating liquid, and a charge transport substance represented by the general formula (1), a curable compound, surface-treated tin oxide, a silica particle, and if necessary, various additives are added in a solvent and stirred until the mixture is dissolved or dispersed. Further, there is no particular restriction on the amount of a solvent, and it should be adjusted appropriately so that the coating liquid comes to have suitable viscosity for a coating operation.

There is no particular restriction on a coating method, and a heretofore known method, such as a dip coating method, a spray coating method, a spin coating method, a bead coating method, a blade coating method, a beam coating method, a slide hopper method, and a circular slide hopper method, can be applied.

After coating the coating liquid, a coated film is formed by air drying or thermal drying, and irradiated with an active energy ray for curing to yield a resin component as a monomer component including a curable compound and surface-treated tin oxide. As an active energy ray, an ultraviolet ray or an electron beam is preferable and an ultraviolet ray is more preferable.

There is no particular restriction on a light source for an ultraviolet ray, and any light source can be used insofar as it emits an ultraviolet ray. Examples of a usable light source include a low-pressure mercury lamp, a medium-pressure mercury lamp, a high-pressure mercury lamp, an ultra-high pressure mercury lamp, a carbon-arc lamp, a metal halide lamp, a xenon lamp, and a flash (pulse) xenon lamp. Although irradiation conditions are different for each lamp, the irradiation dose of an ultraviolet ray is usually 5 to 500 mJ/cm$^2$, preferably 5 to 100 mJ/cm$^2$. The power of a light source is preferably 0.1 to 5 kW, and more preferably 0.5 to 3 kW.

There is no particular restriction on an electron beam irradiation apparatus to be used as an electron beam source, and generally a curtain type beam apparatus, which is relatively inexpensive and can produce high power, is favorably used as an electron beam accelerator for electron beam irradiation. The accelerating voltage for an electron beam irradiation is preferably 100 to 300 kV. The absorbed dose is preferably 0.5 to 10 Mrad.

The irradiation time required for receiving a necessary irradiation dose of an active energy ray is preferably 0.1 sec to 10 min, and from a viewpoint of work efficiency more preferably 0.1 sec to 5 min.

In the course of forming a protection layer, before or after the irradiation with an active energy ray, or during the irradiation with an active energy ray, drying can be performed, and the timing of drying can be selected appropriately in combination, of the above.

The conditions for drying can be selected appropriately depending on the kind of a solvent, the film thickness, etc. The drying temperature is preferably 20 to 180° C., and more preferably 80 to 140° C. The drying time is preferably 1 to 200 mm and more preferably 5 to 100 min.

The film thickness of a protection layer is preferably 0.2 to 10 μm, and more preferably 0.5 to 6 μm.

[Constitution, of Organic Photoreceptor]

The constitution of an organic photoreceptor other than the protection layer will be described below.

An organic photoreceptor means for the purpose of the present invention an electrophotographic photoreceptor constituted by an organic compound having at least one of a charge generating function and a charge transport function, which is indispensable for constituting an electrophotographic photoreceptor, and include all of heretofore known organic photoreceptors, such as a photoreceptor constituted of a heretofore known organic charge generating material or organic charge transport substance, and a photoreceptor, in which a charge generating function and a charge transport function are constituted by a polymer complex.

An organic photoreceptor according to the present invention has a layered structure laminating a charge generating layer and a charge transport layer as a photosensitive layer on an electroconductive substrate, and a protection layer on the photosensitive layer successively. The organic photoreceptor has preferably a middle layer between the electroconductive substrate and the charge generating layer.

Focusing on the layered structure, the constitution of an organic photoreceptor according to the present invention will be described.

<Electroconductive Substrate>

As an electroconductive substrate according to the present invention, any electroconductive substrate may be used insofar as it is conductive. Specific examples thereof include a metal, such as aluminum, copper, chromium, nickel, zinc and stainless-steel, formed into a drum shape (cylindrical) or into a sheet form; a metallic foil of aluminum, copper, or the like laminated on a plastic film and; a plastic film evaporated with aluminum, indium oxide, tin oxide, or the like; a metal, a plastic film, and paper provided with an electroconductive layer by coating an electroconductive material solely or together with a binder resin.

<Middle Layer>

According to the present invention, a middle layer having a barrier function and an adhesion function may be formed between an electroconductive substrate and a photosensitive layer. In view of prevention of various failures, it is a preferable mode to have a middle layer.

A middle layer can be formed by preparing a coating liquid by dissolving a binder resin such as casein, polyvinyl alcohol, nitrocellulose, an ethylene-acrylic acid copolymer, a polyamide resin, a polyurethane resin, and gelatin, in a heretofore known solvent, and applying similar coating and drying methods such as a dip coating method as applied to the protection layer. Among others, an alcohol-soluble polyamide resin is preferable. The binder resins may be used singly or in combination of 2 or more kinds thereof.

In order to adjust the resistance of a middle layer, various inorganic particles, such as an electroconductive fine particle and a metallic oxide particle may be added. Example thereof include various metallic oxide particles, such as alumina, zinc oxide, titanium oxide, tin oxide, antimony oxide, indium oxide, and bismuth oxide, and ultra-fine particles, such as tin-doped indium oxide (ITO), antimony-doped tin oxide (ATO), and zirconium oxide.

The metallic oxide particles may be used singly or in combination of 2 or more kinds thereof. If used in combination of 2 or more kinds, it may be in a form of a solid solution or a fusion. The average particle size of such a metallic oxide particle is preferably 0.3 μm or less, and more preferably 0.1 μm or less.

As a solvent to be used in a coating liquid for a middle layer, a solvent, which can disperse well the metallic oxide particle and dissolve the binder resin, especially polyamide resin, is preferable. Specifically, alcohols having 1 to 4 carbon atoms, such as methanol, ethanol, n-propyl alcohol, isopropyl alcohol, n-butyl alcohol, tert-butyl alcohol, and sec-butyl alcohol, are preferable, because they are superior in solubility of a polyamide resin and a coating property. The solvents may be used singly or in combination of 2 or more kinds thereof. Further, in order to improve the storage stability and the dispersibility of an inorganic particle, the solvent and a co-solvent may be used in combination. Examples of a co-solvent, with which a good effect can be attained, include benzyl alcohol, toluene, methylene chloride, cyclohexanone, and tetrahydrofuran.

For forming a middle layer, although there is no particular restriction on a method therefor, a binder resin is dissolved in the solvent, an inorganic particle is dispersed by an apparatus, such as an ultrasonic disperser, a ball mill, a sand mill, and a homo-mixer to prepare a coating liquid; the coating liquid is coated on an electroconductive substrate to a desired thickness; and the coated layer is dried to complete a middle layer. A method for drying the middle layer may be selected appropriately depending on the kind of a solvent and the film thickness, and a thermal drying is preferable.

The concentration of a binder resin in a coating liquid for forming a middle layer is selected appropriately depending on the film thickness of a middle layer or the production speed.

When an inorganic particle is dispersed, the mixing ratio of the inorganic particle to a binder resin is preferably 20 to 400 parts by weight of the inorganic particle, more preferably 50 to 350 parts by weight, with respect to 100 parts by weight of the binder resin.

The film thickness of a middle layer is preferably 0.1 to 15 μm, and more preferably 0.3 to 10 μm.

<Photosensitive Layer>

An organic photoreceptor according to the present invention has a photosensitive layer, and the photosensitive layer has a charge generating layer and a charge transport layer.

<<Charge Generating Layer>>

A charge generating layer according to the present invention contains preferably a charge generating material and a binder resin.

Examples of a charge generating material include, but not limited to, an azo pigment, such as Sudan red, and Diane blue; a quinone pigment, such as pyrrene quinone, and anthanthrone; a quinocyanine pigment; a perylene pigment; an indigo pigment, such as indigo, and thioindigo; a polycyclic quinone pigment, such as pyranthrone, and diphthaloylpyrene; and a phthalocyanine pigment such as a titanyl phthalocyanine pigment. The charge generating materials may be used singly or in combination of 2 or more kinds thereof. Among others, a polycyclic quinone pigment and a titanyl phthalocyanine pigment are preferable. A charge generating material may be added as it is in a coating liquid for a charge generating layer, or added in a dispersed form in a heretofore known resin.

There is no particular restriction on a binder resin for a charge generating layer, and a heretofore known resin can be used. Specific examples thereof include, but not limited to, a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymer resin containing 2 or more of the above (for example, a vinyl chloride-vinyl acetate copolymer resin, and a vinyl chloride-vinyl acetate-maleic anhydride copolymer resin), as well as a polyvinyl carbazole resin. The binder resins may be used singly or in combination of 2 or more kinds thereof. A polyvinyl butyral resin is preferable.

Although there is no particular restriction on a method for forming a charge generating layer, preferably, a charge generating material is dispersed by a dispersing machine in a solution of a binder resin dissolved in a solvent to prepare a coating liquid; the obtained coating liquid for a charge generating layer is coated by a coater to a constant film thickness; and the obtained coated film is dried. As a coating method, a similar method as exemplified in the description concerning the protection layer may be adopted.

Examples of a solvent to be used in a coating liquid for a charge generating layer include, but not limited to, toluene, xylene, methylene chloride, 1,2-dichloroethane methyl ethyl ketone, cyclohexane, ethyl acetate, tert-butyl acetate, methanol, ethanol, n-propyl alcohol, isopropyl alcohol, n-butyl alcohol, tert-butyl alcohol, sec-butyl alcohol, butanol, methyl cellosolve, 4-methoxy-4-methyl-2-pentanone, ethyl cellosolve, tetrahydrofuran, 1-dioxane, 1,3-dioxolane, pyridine, and diethylamine. The solvents may be used singly or in combination of 2 or more kinds thereof.

Examples of a dispersing means for a charge generating material include, but not limited to, an ultrasonic disperser, a ball mill, a sand mill, and a home-mixer.

The mixing ratio of a charge generating material to the binder resin is preferably 1 to 600 parts by weight of a charge generating material, more preferably 50 to 500 parts by weight, with respect to 100 parts by weight of the binder resin. The film thickness of a charge generating layer may be selected appropriately depending on the property of a charge generating material, the property of the binder resin and the mixing ratio, and is preferably 0.01 to 5 μm, more preferably 0.05 to 3 μm. If a coating liquid for a charge generating layer is filtrated to remove a foreign matter or an aggregate before coating, appearance of an image defect can be prevented. Further, a charge generating layer can also be formed by vacuum evaporation of the above pigment.

(Charge Transport Layer)

A charge transport layer to be used for a photoreceptor according to the present invention contains preferably a charge transport compound and a binder resin.

Specific examples of a charge transport compound include, but not limited to, a triphenylamine derivative, a hydrazone compound, a styryl compound, a benzidine compound, and a butadiene compound.

The charge transport compounds may be used singly or in combination of 2 or more kinds thereof. As the charge transport compound, a commercial product may be used, and a synthesized product may be also used. Examples of a synthesis method include synthesis methods described in JP-A-2010-26428, and JP-A-2010-91707.

As a binder resin for a charge transport layer, a heretofore known resin can be used without particular restriction. Specific examples thereof include a polycarbonate resin, a polyacrylate resin, a polyester resin, a polystyrene resin, a styrene-acrylonitrile copolymer resin, a polymethacrylic acid ester resin, and a styrene-methacrylic acid ester copolymer resin, and a polycarbonate resin is preferable. The binder resins may be used singly or in combination of 2 or more kinds thereof. From viewpoints of crack resistance, abrasion resistance, and a charging property, polycarbonate A containing bisphenol A (EPA) as a monomer component, polycarbonate Z containing 1,1-bis(4-hydroxyphenyl)cyclohexane (bisphenol Z, BPZ) as a monomer component, a polycarbonate resin containing dimethyl bisphenol A (dimethyl EPA) as a monomer component, and a polycarbonate resin containing EPA and dimethyl EPA as a monomer component are preferable.

Although there is no particular restriction on a method for forming a charge transport layer, preferably, a charge transport compound is dispersed by a dispersing machine in a solution of a binder resin dissolved in a solvent to prepare a coating liquid; the obtained coating liquid for a charge transport layer is coated by a coater to a constant film thickness; and the obtained coated film is dried. As a coating method, a similar method as exemplified in the description concerning the protection layer may be adopted.

Examples of a solvent to be used in a coating liquid for a charge transport layer include, but not limited to, toluene, xylene, methylene chloride, 1,2-dichloroethane methyl ethyl ketone, cyclohexanone, ethyl acetate, butyl acetate, methanol, ethanol, propanol, butanol, tetrahydrofuran, 1,4-dioxane, 1,3-dioxolane, pyridine, and ethylamine. The solvents may be used singly or in combination of 2 or more kinds thereof.

The mixing ratio of a charge transport compound to the binder resin is preferably 10 to 500 parts by weight, more preferably 20 to 250 parts by weight, to 100 parts by weight of the binder resin.

The film thickness of a charge transport layer may be selected appropriately depending on the property of a charge transport compound, the property of the binder resin and the mixing ratio, and is preferably 5 to 40 μm, more preferably 10 to 30 μm.

In a charge transport layer, an antioxidant, an electronic conductor, a stabilizer, a silicone oil, and the like may be further added. As an antioxidant those described in JP-A-2000-305291, and as an electronic conductor those described in JP-A-S50-137543 or JP-A-S58-76483 are preferable.

[Image Formation Apparatus]

An organic photoreceptor according to the present invention is used favorably in an image formation apparatus.

FIG. 1 is a schematic sectional view showing a color image formation apparatus provided with an organic photoreceptor according to an embodiment of the present invention.

The color image formation apparatus is a so-called tandem color image formation apparatus composed of 4 sets of image formation sections (image formation units) 10Y, 10M, 10C, and 10Bk; an endless belt-form intermediate transfer medium unit 7; a paper feed-conveyance means 21; and a fixing means 24. On the upper part of the main body A of the image formation apparatus is placed a manuscript image reading apparatus SC.

The image formation section 10Y forming a yellow color image has a charging means (charging step) 2Y, an exposing means (exposing step) 3Y, a developing means (developing step) 4Y, a primary transferring roller 5Y as a primary transferrin means (primary transferring step) and a cleaning means 5Y, placed around a drum-form photoreceptor by as the first image carrier. The image formation section 10M forming a magenta color image has a drum-form photoreceptor 1M as the first image carrier, a charging means 2M, an exposing means 3M, a developing means 4M, a primary transferring roller 5M as a primary transferring means, and a cleaning means 6M. The image formation section 10C forming a cyan color image has a drum-form photoreceptor 1C as the first image carrier, a charging means 2C, an exposing means 3C, a developing means 4C, a primary transferring roller 5C as a primary transferring means and a cleaning means 6C. The image formation section 10Bk forming a black color image has a drum-form photoreceptor 1Bk as the first image carrier, a charging means 2Bk, an exposing means 3Bk, a developing means 4Bk, a primary transferring roller 5Bk as a primary transferring means, and a cleaning means 6Bk. An image formation apparatus according to the present invention utilizes the organic photoreceptor according to the present invention as the photoreceptors 1Y, 1M, 1C, and 1Bk. As described above the organic photoreceptor according to the present invention is superior in the abrasion resistance and the scratch resistance of the protection layer, and can prevent increase in the residual potential or appearance of the transfer memory, and its voltage holding property is stable. Consequently, an image formation apparatus equipped with the organic photoreceptor according to the present invention can provide stably for a long time period good electrophotographic images.

The 4 sets of image formation units 10Y, 10M, 10C, and 10Bk are constituted, centering on the photoreceptors 1Y, 1M, 1C, and 1Bk respectively, with charging means 2Y, 2M, 2C, and 2Bk; exposing means 3Y, 3M, 3C, and 3Bk; revolving developing means 4Y, 4M, 4C, and 4Bk; cleaning means 6Y, 6M, 6C, and 6Bk for cleaning the photoreceptors 1Y, 1M, 1C, and 1Bk.

Since the image formation units 10Y, 10M, 10C, and 10Bk are constituted identically except solely that the colors of toner images formed respectively on the photoreceptors 1Y, 1M, 1C, and 1Bk, are different, the details will be described taking the image formation unit 10Y as an example.

In the image formation unit 10Y, a charging means 2Y (hereinafter referred to simply as "charging means 2Y" or "charger 2Y"), an exposing means 3Y, a developing means 4Y, and a cleaning means 6Y (hereinafter referred to simply as "cleaning means 6Y" or "cleaning blade 6Y") are placed around a photoreceptor 1Y as an image forming member for forming a toner image of yellow (Y) on the photoreceptor 1Y. In the current embodiment, in the image formation unit 10Y, at least a photoreceptor 1Y, a charging means 2Y, a developing means 4Y, and a cleaning means 6Y are provided as an integrated unit.

The charging means 2Y is a means for applying a constant voltage to the photoreceptor 1Y, and in the current embodiment a corona discharger-type charger 2Y is used for the photoreceptor 1Y.

The exposing means 3Y is a means for forming an electrostatic latent image corresponding to a yellow image by performing exposure based on image signals (yellow) on the photoreceptor 1Y to which a constant voltage has been applied by the charger 2Y. As the exposing means 3Y, a system that constituted with an LED with light emitting elements aligned in an array along the axis of the photoreceptor 1Y and an imaging element, or a laser optic system is utilized.

The developing means 4Y is composed of a developing sleeve having a built-in magnet and revolving while retaining a developing agent, and a voltage applying apparatus applying a direct current and/or alternating current bias voltage between the organic photoreceptor and the developing sleeve.

The cleaning means 6Y is composed of a cleaning blade and a brush roller placed upstream of the cleaning blade.

For an image formation apparatus according to the present invention, the organic photoreceptor and the components, such as a developing device and a cleaning device, may be unified as a process cartridge (image formation unit), and the image formation unit may be mounted detachably on the apparatus main body. Further, at least one of a charger, an image exposing device, a developing device, a transferring or separating device, and a cleaning device may be supported integrally with the photoreceptor to form a detachable process cartridge (image formation unit) for the apparatus main body. The integrated image formation unit may be so constituted that it can be mounted detachably using a guiding means such as a rail of the apparatus main body.

The endless belt-form intermediate transfer medium unit 7 has an endless belt-form intermediate transfer medium 70 as the second image carrier in a semi-conductive endless belt form wound circularly by plural rollers and supported for moving rotationally.

The fixing means 24 is, for example, a heating roller fixing system, which is composed of a heating roller having a built-in heating source and a press roller mounted contacting the heating roller under pressure forming a fixing nip section.

The respective color images formed by the image formation units 10Y, 10M, 10C, and 10Bk are transferred one by one onto the rotating endless belt-form intermediate transfer medium 70 by the primary transferring roller 5Y, 5M, 5C, and 5Bk as the primary transferring means to form a synthesized color image. An image carrier P, as a transfer medium material (an image carrier retaining the fixed final image, such as plain paper, and a transparent sheet), which is contained in a paper feed cassette 20 is supplied by a paper feed means 21 and conveyed through plural intermediate rollers 22A, 22B, 22C, and 22D, and a resist roller 23 to a secondary transferring roller 5*b* as a secondary transferring means, where color images are transferred collectively onto the image carrier P by secondary transfer. The image carrier P with the transferred color image is subjected to a fixing treatment by a fixing means 24, nipped by paper discharging rollers 25, and placed on a receiving tray 26 outside the machine. In this regard, carriers of a transferred toner image formed on a photoreceptor, such as an intermediate transfer medium and an image carrier, are collectively referred to as a transfer medium.

Meanwhile, from the endless belt-form intermediate transfer medium 70 having transferred a color image to an image carrier P by the secondary transferring roller 5*b* as the secondary transferring means and having self-stripped the image carrier P, a residual toner is removed by the cleaning means 6*b*.

During the image formation processing, the primary transferring roller 5Bk contacts always the photoreceptor 1Bk. While, other primary transferring rollers 5Y, 5M, and SC contact the respective corresponding photoreceptors 1Y, 1M, and 1C, only in the case of color image formation.

The secondary transferring roller 5*b* contacts the endless belt-form intermediate transfer medium 70, only when an image carrier P passes there for secondary transfer.

A casing 8 can be taken out from the apparatus main body A by means of support rails 82L, 82R.

The casing 8 is composed of the image formation sections 100, 10M, 10C, and 10Bk, and the endless belt-form intermediate transfer medium unit 7.

The image formation sections 10Y, 10M, 10C, and 10Bk are arranged from top to bottom vertically. In FIG. 1 on the left side of the photoreceptors 1Y, 1M, 1C, and 1Bk, the endless belt-form intermediate transfer medium unit 7 is located. The endless belt-form intermediate transfer medium unit 7 is composed of an endless belt-form intermediate transfer medium 70 rotatably wound around rollers 71, 72, 73, and 74, primary transferring rollers 5Y, 5M, 5C, and 5Bk, and a cleaning means 6*b*.

Although a color laser printer is shown in FIG. 1 as an image formation apparatus, the present invention is naturally also applicable to a black-and-white laser printer or copier. Further, as an exposing source, a light source other than laser light, for example, an LED light source can be used.

EXAMPLES

Next, the present invention will be described in more details referring to an actual constitution and its effect, provided that modes of the present invention are not limited thereto. The expression of "part" means hereinbelow "part by weight".

Example 1

Production of Photoreceptor 1

A photoreceptor 1 was produced as follows.

The surface of a cylindrical aluminum substrate with the diameter of 60 mm was cut finely to form a roughened surface to prepare an electroconductive substrate.

<Middle Layer>

A dispersion having the composition shown in the following Table 1 was diluted 2-fold with the same solvent, left standing overnight, and then filtrated (Rigimesh 5 μm filter, by Pall Corporation) to prepare a coating liquid for a middle layer.

TABLE 1

| | |
|---|---|
| Polyamide resin: CM8000 (by Toray Industries, Inc.) | 1 part |
| Titanium oxide: SMT500SAS (by Tayca Corporation) | 3 parts |
| Methanol | 10 parts |

A sand mill was used as a disperser and dispersion was performed batch-wise for 10 hours.

The coating liquid was coated on the substrate by a dip coating method and dried to form a middle layer with the film thickness of 2 μm.

<Charge Generating Layer>

The components shown in the following Table 2 were mixed and dispersed by a sand mill for 10 hours to prepare a coating liquid for a charge generating layer. The coating liquid was coated on the middle layer by a dip coating method and dried to form a charge generating layer with the film thickness of 0.3 μm.

TABLE 2

| | |
|---|---|
| Charge generating material: pigment (CG-1) shown below | 20 parts |
| Polyvinyl butyral resin (#6000-C: by Denki Kagaku Kogyo Kabushiki Kaisha) | 10 parts |
| tent-butyl acetate | 700 parts |
| 4-methoxy-4-methyl-2-pentanone | 300 parts |

(Synthesis of Pigment (CG-1))

(1) Synthesis of Amorphous Titanyl Phthalocyanine

In 200 parts by weight of o-dichlorobenzene was dispersed 29.2 parts by weight of 1,3-diiminoisoindoline, then 20.4 parts by weight of titanium tetra-n-butoxide was added and the mixture was heated from 150 to 160° C. under a nitrogen atmosphere for 5 hours. After standing to cool, deposited crystals were filtrated, washed with chloroform, a 2% hydrochloric acid aqueous solution, water, and methanol, and dried to obtain 26.2 parts by weight (yield 91%) of crude titanyl phthalocyanine.

Then the obtained crude titanyl phthalocyanine was stirred for dissolution in 250 parts by weight of concentrated sulfuric acid at 5° C. or below for 1 hour, and the solution was poured into 5000 parts by weight of water at 2° C. Deposited crystals were filtrated, and washed thoroughly with water to obtain 225 parts by weight of wet paste.

The obtained wet paste was frozen in a freezer, thawed again, filtrated, and dried to obtain 24.8 parts by weight (yield 86%) of amorphous titanyl phthalocyanine.

(2) Synthesis of Titanyl Phthalocyanine Adducted with (2R, 3R)-2,3-butanediol (CG-1)

In 200 parts by weight of o-chlorobenzene (ODB), 10.0 parts by weight of the amorphous titanyl phthalocyanine and 0.94 part by weight (0.6 equivalent ratio) of (2R,3R)-2,3-butanediol were mixed (the equivalent ratio is an equivalent ratio with respect to the amorphous titanyl phthalocyanine, the same holds hereinbelow), and stirred with heating at 60 to 70° C. for 6 hours. After standing overnight, methanol was added to the reaction solution, and deposited crystals were filtrated, and washed with methanol to yield 10.3 parts by weight of a pigment CG-1 containing titanyl phthalocyanine adducted with (2R,3R) 2,3-butanediol. The X-ray diffraction spectrum of CG-1 shows clear peaks at 8.3°, 24.7°, 25.1°, and 26.5°. The weight spectrum shows peaks at 576 and 648, and the IR spectrum shows both the absorptions of Ti═O near 970 $cm^{-1}$ and O—Ti—O near 30 $cm^{-1}$. A thermogravimetric analysis (TG) shows weight reduction of about 7% from 390 to 410° C. suggesting a mixture of a 1:1 adduct of titanyl phthalocyanine with (2R,3R)-2,3-butanediol and not adducted (free) titanyl phthalocyanine.

The BET specific surface area of the obtained CG-1 was measured by a flow-type specific surface area automated measuring apparatus (Micromeritics FlowSorb Type by Shimadzu Corporation) to find 31.2 $m^2/g$.

<Charge Transport Layer>

The components shown in the following Table 3 were mixed and dissolved to prepare a coating liquid for a charge transport layer. The coating liquid was coated on the charge generating layer formed as above by a circular slide hopper coater, and dried to form a charge transport layer with the film thickness of 20 μm.

TABLE 3

| | |
|---|---|
| Charge transport compound (compound A represented by the following chemical formula) | 225 parts |
| Binder: Polycarbonate Z (Z300, by Mitsubishi Gas Chemical Co., Inc. ) | 300 parts |
| Antioxidant (Irganox (Registered trademark) 1010, by Ciba-Geigy Japan Ltd.) | 6 parts |
| THF (tetrahydrofuran) | 1600 parts |
| Toluene | 400 parts |
| Silicone oil (KF-50: by Shin-Etsu Chemical Co., Ltd.) | 1 part |

[Chem. 13]

Compound A

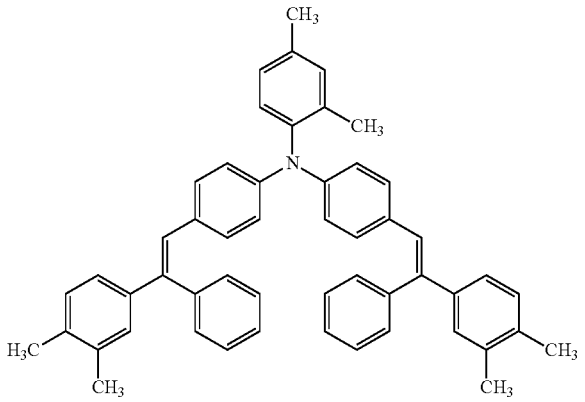

<Protection Layer>

Using tin oxide having the following properties as tin oxide and using a compound represented by the chemical formula S-15 above as a surface preparation agent having a reactive organic group, a surface treatment was carried out as follows.

Firstly, a mixture liquid of 100 parts of tin oxide, 30 parts of a compound represented by the chemical formula S-15, and 300 parts of a mixture solvent of toluene/isopropyl alcohol=1/1 (weight ratio) was charged into a sand mill together with zirconia beads and agitated at approx. 40° C. with the rotation speed of 1500 rpm to surface-treat the tin oxide particle with the surface preparation agent having a reactive organic group. Then the treated mixture was taken out and charged into a Henschel mixer, agitated with the rotation speed of 1500 rpm for 15 ruin, and then dried at 120° C. for 3 hours to complete the surface treatment of the tin oxide thereby obtaining surface-treated tin oxide. That the particle surface of the tin oxide was covered by the surface preparation agent represented by the chemical formula S-15 by the above surface treatment was confirmed by detecting the peak of Si by a fluorescent X-ray analyzer (XRF-1700, by Shimadzu Corporation).

As the tin oxide, tin oxide made by CIX Nanotek Corporation (number average primary particle size: 20 nm, volume resistivity: $1.05\times10^5$ Ω·cm) was used.

Then, a protection layer was formed as follows.

TABLE 4

| | |
|---|---|
| Surface-treated tin oxide (surface-treated with the compound represented by the chemical formula S-15) | 50 parts |
| Curable compound (compound represented by the chemical formula M1) | 100 parts |
| Charge transport substance (compound represented by the chemical formula CTM-8) | 15 parts |
| Polymerization initiator (compound of the polymerization initiator 3-2) | 10 parts |
| Silica particle (Aerosil (Registered trademark) RX-50, by Nippon Aerosil Co., Ltd.) | 10 parts |
| sec-butyl alcohol | 320 parts |
| Tetrahydrofuran | 80 parts |

The components listed in the Table 4 were mixed and stirred to be dissolved or dispersed thoroughly to prepare a coating liquid for a protection layer. The coating liquid for a protection layer was coated by a circular slide hopper coater on the photoreceptor prepared up to the charge transport layer. After coating, the coat was irradiated with an ultraviolet ray using a metal halide lamp for 1 min (irradiation intensity: 15 $mW/cm^2$), and dried at 80° C. for 120 min. to form a protection layer with the dry film thickness of 3.0 μm, thereby completing a photoreceptor 1.

Examples 2 to 14

Production of Photoreceptors 2 to 14

Photoreceptors 2 to 14 were produced identically with Example 1, except that the kind and the addition amount of a charge transport substance for a protection layer, the addition amount of the surface-treated tin oxide, and the kind and the addition amount of a silica particle were changed as described in Table 5. The silica particle "NAX-50" in Table 5 means Aerosil (Registered trademark) NAX-50 (by Nippon Aerosil Co., Ltd.).

Comparative Example 1

Production of Photoreceptor 15

Photoreceptor 15 was produced identically with Example 9, except that no silica particle was used.

Comparative Example 2

Production of Photoreceptor 16

Photoreceptor 16 was produced identically with Example 9, except that the compound represented by the following chemical formula CTM-16 was used as a charge transport substance.

[Chem. 14]

CTM-16

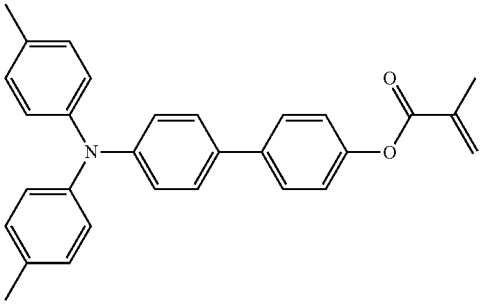

(Mol. weight: 479.55)

Comparative Example 3

Production of Photoreceptor 17

Photoreceptor 17 was produced identically with Example 9, except that the surface-treated tin oxide was not used.

The compositions of photoreceptors 1 to 17 are shown in the following Table 5.

TABLE 5

| | Photo receptor No. | Charge transport substance in protection layer Kind | Charge transport substance in protection layer Addition amount (part by weight) | Tin oxide Addition amount (part by weight) | Silica particle Kind | Silica particle Addition amount (part by weight) |
|---|---|---|---|---|---|---|
| Example 1 | 1 | CTM-8 | 20 | 80 | RX-50 | 15 |
| Example 2 | 2 | CTM-8 | 20 | 80 | RX-50 | 10 |
| Example 3 | 3 | CTM-8 | 20 | 80 | RX-50 | 20 |
| Example 4 | 4 | CTM-8 | 20 | 80 | RX-50 | 25 |
| Example 5 | 5 | CTM-8 | 20 | 80 | RX-50 | 30 |
| Example 6 | 6 | CTM-8 | 20 | 60 | RX-50 | 15 |
| Example 7 | 7 | CTM-8 | 20 | 120 | RX-50 | 15 |
| Example 8 | 8 | CTM-11 | 20 | 80 | RX-50 | 15 |
| Example 9 | 9 | CTM-14 | 20 | 80 | RX-50 | 15 |
| Example 10 | 10 | CTM-14 | 5 | 80 | RX-50 | 15 |
| Example 11 | 11 | CTM-14 | 15 | 80 | RX-50 | 15 |
| Example 12 | 12 | CTM-14 | 25 | 80 | RX-50 | 15 |
| Example 13 | 13 | CTM-14 | 35 | 80 | RX-50 | 15 |
| Example 14 | 14 | CTM-8 | 20 | 80 | NAX-50 | 15 |

TABLE 5-continued

| | Photo receptor No. | Charge transport substance in protection layer Kind | Charge transport substance in protection layer Addition amount (part by weight) | Tin oxide Addition amount (part by weight) | Silica particle Kind | Silica particle Addition amount (part by weight) |
|---|---|---|---|---|---|---|
| Comparative Example 1 | 15 | CTM-14 | 20 | 80 | RX-50 | 0 |
| Comparative Example 2 | 16 | CTM-16 | 20 | 80 | RX-50 | 15 |
| Comparative Example 3 | 17 | CTM-14 | 20 | 0 | RX-50 | 15 |

(Evaluation)

Evaluations were conducted by using a modified machine of Bizhub (Registered trademark) PRO C6501 (by Konica Minolta Business Technologies. Inc.) having basically the structure of FIG. 1 (exposing light was changed to 405 nm semiconductor laser light) as an evaluating machine, and mounting the respective photoreceptors on the evaluating machine.

An endurance test was conducted in an environment of 30° C./80% HH by printing a character image with the image ratio of 6 continuously on double faces of 300,000 sheets each by A4 long edge feed. In the endurance test or after the endurance test, evaluations of the abrasion resistance and residual potential and image memory of the photoreceptor were carried out. The evaluation was conducted according to the following guideline.

(Voltage Holding Property)

After the endurance test a photoreceptor was charged by applying the surface voltage of −700 V and the power was turned off immediately thereafter, then after 5 sec the voltage holding ratio (%) of the photoreceptor was measured.

Voltage holding ratio(%)=(Surface voltage after 5 sec/Surface voltage immediately after the charging)×100

The surface voltage was measured by installing a surface voltage meter at the position of the developing means of the evaluating machine.

(Abrasion Resistance)

An evaluation was made by measuring the film thicknesses of a photosensitive layer before and after the endurance test, and calculating the film thickness abrasion amount.

The film thickness of a photosensitive layer was determined by measuring the film thickness of a photosensitive layer at 10 points randomly selected in a part with uniform film thickness (excluding parts with fluctuating film thicknesses at the frontal end and the rear end of the coat, by producing a film thickness profile), and calculating the mean value. As a film thickness measuring apparatus, an eddy-current type film thickness measuring apparatus EDDY560C (by Helmut Fischer GmbH+Co) was used and the difference of the film thicknesses of a photosensitive layer before and after the actual printing test was deemed as the film thickness abrasion amount. α value was defined as the abrasion amount per 100 krot (100,000 rotation).

(Residual Potential)

Evaluation was made according to the magnitude of potential fluctuation of the potential at an exposed part in the endurance test. Namely, evaluation was made according to the potential change (ΔV) at the exposed part between the initial stage and after printing 300,000 sheets, while the initial static voltage was adjusted to 600±50 V.

(Image Memory)

Evaluation was made after endurance test by printing on successive 10 sheets an image, in which solid black parts and solid white parts coexist intermingled, then printing a uniform halftone image, and examining whether a memory of the solid black parts and the solid white parts appeared in the halftone image by determining the difference (ΔID) between the reflection density of a region of the halftone image corresponding to the solid black image part and the reflection density of a region of the halftone image corresponding to the solid white image part. The rating was made according to the following evaluation criteria.

The reflection density was measured by a Macbeth reflection densitometer "RD-918" (by Macbeth).

Evaluation Criteria

A: ΔID is not more than 0.05 (good)

B: ΔID is more than 0.05 and not more than 0.10 (acceptable for practical use)

C: ΔID is more than 0.10 (unacceptable for practical use)

The evaluation results on the photoreceptors 1 to 17 are summarized in the following Table 6.

TABLE 6

| | Photo-receptor No. | Voltage holding ratio (%) | Abrasion resistance α value (μm/100 krot) | Residual potential (ΔV) | Image memory |
|---|---|---|---|---|---|
| Example 1 | 1 | 93.2 | 0.16 | 44 | A |
| Example 2 | 2 | 93.3 | 0.16 | 46 | B |
| Example 3 | 3 | 93.4 | 0.17 | 45 | A |
| Example 4 | 4 | 93.5 | 0.18 | 48 | A |
| Example 5 | 5 | 93.5 | 0.18 | 50 | A |
| Example 6 | 6 | 92.1 | 0.32 | 82 | B |
| Example 7 | 7 | 94.5 | 0.02 | 35 | A |
| Example 8 | 8 | 93.3 | 0.17 | 44 | A |
| Example 9 | 9 | 93.2 | 0.15 | 45 | A |
| Example 10 | 10 | 91.1 | 0.03 | 53 | B |
| Example 11 | 11 | 93.1 | 0.09 | 49 | A |
| Example 12 | 12 | 93.3 | 0.18 | 46 | A |
| Example 13 | 13 | 93.4 | 0.21 | 43 | A |
| Example 14 | 14 | 93.2 | 0.17 | 55 | B |
| Comparative Example 1 | 15 | 91.3 | 0.17 | 60 | C |
| Comparative Example 2 | 16 | 90.6 | 0.12 | 102 | C |
| Comparative Example 3 | 17 | 88.7 | 0.62 | 120 | C |

As obvious from the results in Table 6, the photoreceptors (1 to 14) suitable for shortwave with a protection layer containing a charge transport substance having a structure represented by the general formula (1), a resin component obtained by curing a curable compound and tin oxide treated with a surface preparation agent having a reactive organic group, and a silica particle, could obtain good evaluation with respect to each evaluation item.

On the other hand, photoreceptor 15 not containing a silica particle, photoreceptor 16 containing a charge transport substance having a reactive organic group, and photoreceptor 17 not containing surface-treated tin oxide has drawback in at least one of the voltage holding ratio, the abrasion resistance, the residual potential, and the image memory.

[Reference Signs List]

| | |
|---|---|
| 1Y, 1M, 1C, 1Bk | PHOTORECEPTOR, |
| 2Y, 2M, 2C, 2Bk | CHARGING MEANS, |
| 3Y, 3M, 3C, 3Bk | EXPOSING MEANS, |
| 4Y, 4M, 4C, 4Bk | DEVELOPING MEANS, |
| 5Y, 5M, 5C, 5Bk | PRIMARY TRANSFERRING ROLLER, |
| 5b | SECONDARY TRANSFERRING ROLLER, |
| 6Y, 6M, 6C, 6Bk, 6b | CLEANING MEANS, |
| 7 | INTERMEDIATE TRANSFER MEDIUM UNIT, |
| 8 | CASING, |
| 10Y, 10M, 10C, 10Bk | IMAGE FORMATION UNIT, |
| 20 | PAPER FEED CASSETTE, |
| 21 | PAPER FEED MEANS, |
| 22A, 22B, 22C, 22D | INTERMEDIATE ROLLER, |
| 23 | RESIST ROLLER, |
| 24 | FIXING MEANS, |
| 25 | PAPER DISCHARGING ROLLERS, |
| 26 | RECEIVING TRAY, |
| 70 | INTERMEDIATE TRANSFER MEDIUM, |
| 71, 72, 73, 74 | ROLLER, |
| 82L, 82R | SUPPORT RAIL, |
| P | IMAGE CARRIER. |

What is claimed is:

1. An organic photoreceptor constituted by laminating on an electroconductive substrate, a photosensitive layer and a protection layer successively, wherein the protection layer comprises a charge transport substance represented by the following general formula (1), a resin component obtained by curing a curable compound and tin oxide treated with a surface preparation agent having a reactive organic group, and a silica particle:

general formula (1)

(1)

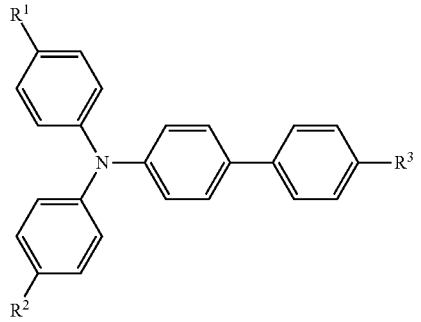

in the general formula (1), $R^1$ and $R^2$ are each independently hydrogen atoms or methyl groups, and $R^3$ is a straight-chain or branched alkyl group having 1 to 5 carbon atoms.

2. The organic photoreceptor according to claim 1, wherein the reactive organic group is an acryloyl group or a methacryloyl group.

3. The organic photoreceptor according to claim 1, wherein the curable compound is a (meth)acrylic monomer or a (meth)acrylic oligomer having an acryloyl group or a methacryloyl group.

4. The organic photoreceptor according to claim 1, wherein $R^1$ and $R^2$ in the general formula (1) are different from each other.

5. The organic photoreceptor according to claim 1, wherein $R^3$ in the general formula (1) is selected from the group consisting of a propyl group, an n-butyl group, and an n-pentyl group.

6. The organic photoreceptor according to claim 1, wherein the addition amount of the charge transport substance represented by the general formula (1) is 2 to 60 parts by weight with respect to 100 parts by weight of the curable compound.

7. The organic photoreceptor according to claim 1, wherein the volume-based average primary particle size of the silica particle is 10 to 50 nm.

8. The organic photoreceptor according to claim 1, wherein the addition amount of the silica particle is 10 to 50 parts by weight with respect to 100 parts by weight of the curable compound.

9. The organic photoreceptor according to claim 1, wherein the number average primary particle size of the tin oxide is 3 to 100 nm.

10. The organic photoreceptor according to claim 1, wherein the addition amount of the tin oxide treated with the surface preparation agent having a reactive organic group is 20 to 170 parts by weight with respect to 100 parts by weight of the curable compound.

* * * * *